United States Patent [19]

Hannen

[11] Patent Number: 4,470,807

[45] Date of Patent: Sep. 11, 1984

[54] HOT-GAS PRODUCING APPARATUS FOR SHRINKING PLASTIC FOILS

[75] Inventor: Rainer W. Hannen, Goch, Fed. Rep. of Germany

[73] Assignee: MSK-Verpackungs-Systeme GmbH, Kalkar-Wissel, Fed. Rep. of Germany

[21] Appl. No.: 376,620

[22] Filed: May 10, 1982

[30] Foreign Application Priority Data

May 9, 1981 [DE] Fed. Rep. of Germany ..... 3118396

[51] Int. Cl.[3] ..... F24H 1/00

[52] U.S. Cl. ..... 432/222; 431/158; 431/285; 431/351

[58] Field of Search ..... 431/158, 285, 350, 351, 431/353; 432/222; 53/557

[56] References Cited

U.S. PATENT DOCUMENTS 3,217,779 11/1965 Reed et al. ..... 431/285
3,529,917 9/1970 Hindenlang ..... 431/351
4,155,700 5/1979 Babington ..... 431/351

*Primary Examiner*—Carroll B. Dority, Jr.
*Attorney, Agent, or Firm*—Shlesinger, Arkwright, Garvey & Fado

[57] ABSTRACT

The invention concerns an apparatus for producing a hot gas to shrink plastic foils, with at least one burner mounted in a housing provided with a discharge nozzle for the hot gas. To better control the hot-gas temperature and hence the temperature of shrinking, the apparatus is provided with such a burner arrangement that the hot-gas jet (9 or 10) leaving the burner (7 or 8) is directed at an angle to the discharge flow defined by the discharge nozzle (6) and with a jet-deflection means for the hot-gas jet (9 or 10) before the discharge nozzle (6).

In a preferred embodiment the jet deflection is implemented by a jet (17) of cold air by means of which the hot-gas jet (9 or 10) is simultaneously directed and cooled. In a preferred mode, the pressure and the flow rate of the cold-air jet (17) are controlled.

7 Claims, 1 Drawing Figure

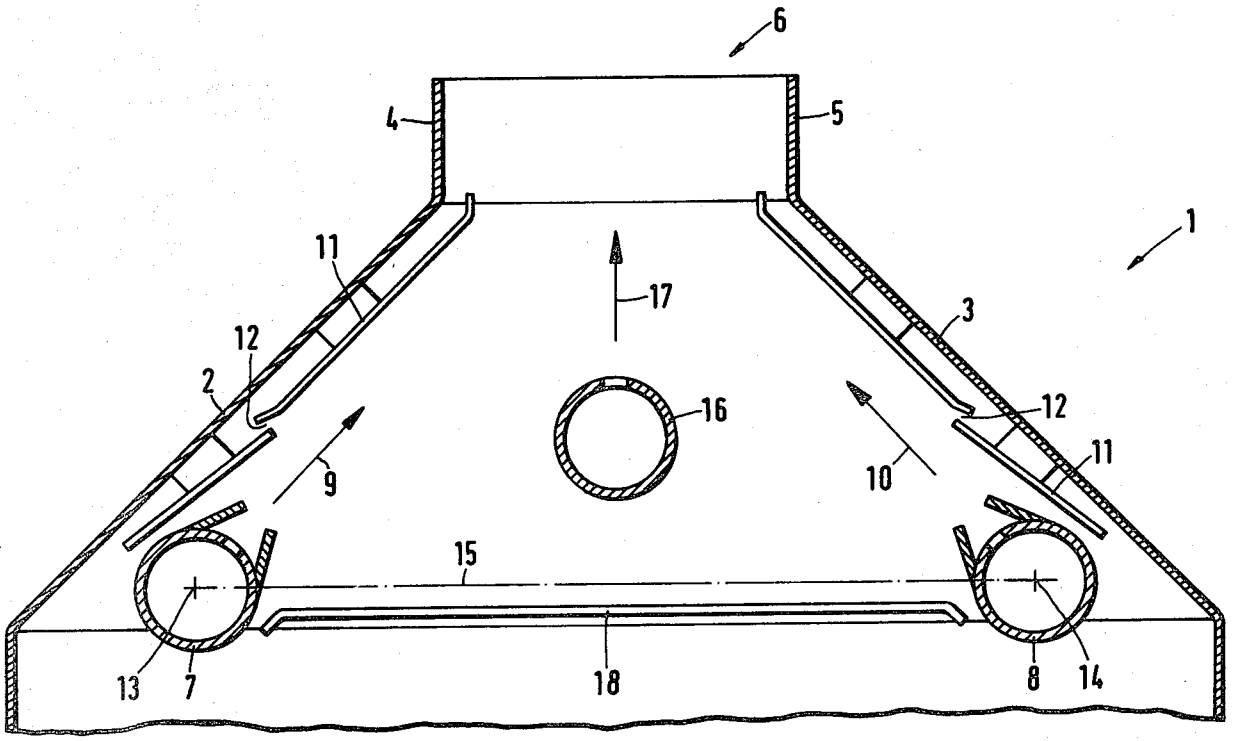
1
2
3
4
5
6
7
8
9
10
11
12
13
14
15
16
17
18

HOT-GAS PRODUCING APPARATUS FOR SHRINKING PLASTIC FOILS

The invention concerns an apparatus for producing a hot gas to shrink plastic foils, with at least one burner mounted in a housing comprising a discharge nozzle for the hot gas. Practically known equipment of this kind comprises several burners arranged along a hood and generating a hot gas directed at a stack of wares over which a shrink wrap is being pulled. The material of the shrink wrap is shrunk by means of a relative motion between the hood and the stack of wares. As a rule the burners of such equipment are arranged in such a manner that the direction of the hot-gas jet coincides with the direction of flow defined by the discharge nozzle. It is frequently observed in this regard that the combustion is not yet completed when the gases enter the discharge nozzle or are leaving it. In any event a flame is visible, which is a bother at least optically. It is furthermore a troublesome matter that under such conditions the hot gases are at a temperature which is excessive for the shrinking of the shrink wrap. In that case it is necessary for instance to change the spacing between the mast and the stack of wares to prevent burning the foil. All this is fairly expensive. It is the object of the invention to palliate this situation.

It is the object of the invention to so improve an apparatus of the initially cited kind that the hot-gas temperature and hence the shrinking temperature can be better controlled.

This problem is solved by means of an apparatus of the initially cited kind which is characterized by a burner arrangement such that the jet of hot gas leaving the burner is directed at an angle to the direction of flow defined by the discharge nozzle, and by a deflection of the hot-gas jet before the discharge nozzle.

In the apparatus of the invention, the jet of hot gas leaving the burner is made to pass along a longer path, thereby providing the possibility of affecting the jet in a variety of ways. Only after the jet arrives at the jet deflection means is it possible to deflect it in the direction of the discharge-nozzle axis, whereupon it enters and passes through the discharge nozzle. On the basis of the longer path alone there is already assurance that there shall be no flame-formation within and without the nozzle.

In the simplest case the deflection of the jet can be in the form of an impact plate or baffle, especially one made of ceramic.

However jet-deflecting means in the form of a jet of cold air offer more ways to influence the hot-air jet, where this cold-air jet exits from an air nozzle mounted in the housing. The jet of cold air preferably is controlled with respect to pressure and rate of flow and allows regulating the hot gases leaving the discharge nozzle. The mixing mechanisms taking place between the jet deflecting means and the discharge nozzle suffice to thoroughly mix the hot gas and the cold air.

To prevent the housing size from becoming unduly bulky, it is recommended to arrange the burner near one wall of the housing and to direct the jet of hot gas parallel to the wall.

The thermal load on the housing wall can be reduced by providing several mutually spaced and/or overlapping space-forming laminations on the inside of this wall. If in addition the gap between the wall and the laminations is hooked-up to a source of cooling air, additional cooling air may be supplied either through an injection effect or by an active blower system.

There are further ways of controlling the jet of hot gas for instance by making the burner and the wall pivotable together about an axis which, when seen from the discharge nozzle, is located in the area of the burner or behind it. This is especially the case if the wall forms a part of the discharge nozzle as thereupon the pivoting of the wall will also enlarge or reduce the nozzle aperture.

A preferred embodiment of the invention is characterized by a two-burner arrangement each arranged on one side of the axis of the discharge nozzle. It is recommended in this case to mount the air nozzle in the area between the discharge nozzle and the line connecting the two burners. In this embodiment it is possible to vary within wide limits the direction of the jets, the jet flow rates and the temperature of the hot gases leaving the discharge nozzle, and to adapt them to the desired conditions.

An illustrative embodiment of the invention is discussed below in relation to the drawings, the single FIGURE in part shows a cross-section of a hot gas hood which is movable with respect to a stack of wares over which was pulled a shrink-wrap.

The hot-gas hood shown in the drawing comprises a housing 1 of a substantially trapezoidal cross-section of which the oblique walls 2,3 merge at the gas discharge side, that is on the side facing the stack of wares, into the walls 4,5 of a discharge nozzle 6. A burner 7 or 8 is mounted in corner areas of the long side of the trapezoid. The burners 7,8 are substantially tubular and are connected to a supply line (omitted) of the combustion gas. The jets 9 and 10 of hot gas discharging from the burners are directed parallel to the walls 2 and 3 resp.

To protect the walls 2,3 against excessive thermal loads, laminations or baffles 11 are mounted on the inside at some spacing from the walls 2 and 3 so that adjoining laminations overlap while forming gaps 12. The housing 1 is connected (but omitted from the drawing) to a supply of cool air at its back, whereby the hot-gas jets 9,10 by an injection effect suck-in cooling air between the walls 2,3 and the laminations placed before these. This cooling air is discharged through the gap 12 and mixed with the jets of hot gas.

In a different embodiment the cooling air can also be introduced by means of a blower.

The walls 2 and 3, and the components fastened to them, pivot together with the associated burners 7 and 8 resp. about the axes 13 and 14 which in the example shown coincide with the axes of the tubular burners 7 and 8.

An air nozzle 16 moreover is mounted in the burner space formed by the housing 1 between the discharge nozzle 6 and a connecting line 15. The air nozzle also is tubular and emits a jet of cold air 17 directed toward the discharge nozzle 6. In the embodiment shown, the air nozzle 16 is mounted in the vicinity of the axis of the discharge nozzle 6, whereby the two hot-gas jets 9,10 and the cold-air jet 17 meet essentially in the area of the discharge nozzle 6 and mix there. At the same time the hot-gas jets are deflected, so that a hot-gas jet of reduced temperature is emitted by the discharge nozzle 6 and subsequently impinges on the shrink wrap.

Omitted from the drawing is the fact that the cold air fed to the air nozzle 16 can be controlled with respect to pressure and flow rate, whereby the hot-gas jet issuing from the discharge nozzle 6 also is controllable with respect to temperature and flow rate.

To prevent that the cold air fed to the housing 1 spread within it in uncontrolled manner, a baffle plate or sheetmetal 18 is mounted between the burners 7 and 8 so to terminate shortly before these burners 7 and 8, whereby the cold air fed to the housing 1 can flow past both sides of each burner 7 and 8.

I claim:

1. Apparatus for generating a hot gas for shrinking plastic foil including:

(a) a housing including opposing walls converging to a discharge nozzle for the hot gas, (b) burner means adjacent one end of each of said opposing walls and arranged to discharge hot gases in the direction toward the other of said walls and toward said nozzle, (c) means forming an air jet intermediate said burner means and directed toward said nozzle, (d) whereby the hot gases from said burner means merge with the air from said air jet intermediate said burner means at said nozzle.

2. Apparatus for generating a hot gas for shrinking plastic foil as in claim 1 and including:

(a) baffle means along each of said opposing walls spaced therefrom and extending from adjacent said burner means to said nozzle, (b) whereby air is induced into said housing and between said baffles and said walls to maintain said walls in cool state.

3. Apparatus fo generating a hot gas for shrinking plastic foil as in claim 2 and wherein:

(a) said baffle means includes spaced baffles having a gap between.

4. Apparatus for generating a hot gas for shrinking plastic foil as in 3 and wherein:

(a) said baffle means each include a lower baffle and an upper baffle.

5. Apparatus for generating hot gas for shrinking plastic foil as in 4 and wherein:

(a) each of said upper baffles extend into said nozzle.

6. Apparatus for generating a hot gas for shrinking plastic foil in claim 2 and including:

(a) a baffle plate spanning said housing between said burner means to control the air flow to the space between said baffle means and said walls.

7. Apparatus for generating a hot gas for shrinking plastic foil as in claim 5 and wherein:

(a) said means forming an air jet is positioned between said baffle means.

* * * * *